US005706722A

United States Patent [19]

Kürten et al.

[11] Patent Number: 5,706,722

[45] Date of Patent: Jan. 13, 1998

[54] PROCESS FOR CONTROLLING A CYLINDER-TYPE SILK SCREEN PRINTING MACHINE

[75] Inventors: Rudolf August Kürten, Bergisch Gladbach, Germany; Bernd Kaluza, Arvada, Colo.

[73] Assignee: RK Siebdrucktechnik GmbH, Bergisch Gladbach, Germany

[21] Appl. No.: 507,220

[22] PCT Filed: Jan. 19, 1994

[86] PCT No.: PCT/DE94/00043

§ 371 Date: Feb. 20, 1996

§ 102(e) Date: Feb. 20, 1996

[87] PCT Pub. No.: WO94/18008

PCT Pub. Date: Aug. 18, 1994

[30] Foreign Application Priority Data

Feb. 13, 1993 [DE] Germany ..... 43 04 399.2

[51] Int. Cl.[6] ..... B41M 1/12

[52] U.S. Cl. ..... 101/129; 101/124

[58] Field of Search ..... 101/124, 114, 101/126, 129, 123

[56] References Cited

U.S. PATENT DOCUMENTS 3,945,317 3/1976 Brasa ..... 101/124

5,101,722 4/1992 Nagatani ..... 101/124

*Primary Examiner*—Ren Yan

*Attorney, Agent, or Firm*—Fildes & Outland, P.C.

[57] ABSTRACT

A cylinder-type silk screen printing machine includes a printing cylinder that collects an object to receive the print and a screen carriage with printing blades applied against the screen pattern, which travels over the cylinder, wherein the screen pattern and cylinder are moved during the printing process at a synchronized speed. In order to reduce the consumption of printing material and hence the environmental pollution, and at the same time to ensure synchronization of the printing cylinder and screen carriage by simple technical means, the printing cylinder and screen carriage are driven independently of one another; data for adjustment of the printing travel and printing speed are programmed into an electronic control system, stored therein and processed to obtain control signals for the drives, and the relevant movement positions of the printing cylinders and screen carriage are determined during the printing process by travel measurement systems and further processed in the electronic system in order to adjust the control signals.

9 Claims, 2 Drawing Sheets

PROCESS FOR CONTROLLING A CYLINDER-TYPE SILK SCREEN PRINTING MACHINE

FIELD OF THE INVENTION

The invention relates to a method for controlling a cylinder screen printing machine, where a printing cylinder, which takes up the material to be printed and is driven by a drive motor, and a screen carriage, which runs above it with a squeegee lowered onto the screen stencil, are moved at a synchronised speed during the printing cycle. The invention also relates to a cylinder screen printing machine with a printing cylinder which takes up the material to be printed and is driven by a drive motor, a screen carriage running above it, a squeegee which can be lowered onto the screen stencil and a device for synchronising the movement of the printing cylinder and the screen frame during the printing cycle, which operates according to the method described above.

BACKGROUND OF THE INVENTION

Two methods of this kind are known from the prior art, in which the printing cylinder and the screen carriage are moved synchronously by a single drive motor via a mechanical link. In both cases, the mechanical link is made via a gear wheel positioned on the end face of the printing cylinder which engages a toothed rack positioned on the corresponding side of the screen carriage. The printing path covered by the screen carriage corresponds exactly to one complete turn of the printing cylinder.

The first method employs a so-called swing cylinder, which has a single gear wheel on each end face which permanently engages the toothed rack mounted on the corresponding side of the screen carriage. Following the printing cycle, the cylinder returns to the starting position, where it takes up the next item to be printed, and the printing cycle starts again immediately from the beginning.

The disadvantage of this method is that the swing cylinder switches directly from one sense of rotation to the other without stopping, so that the newly fed item to be printed must be grasped instantly by the printing cylinder. In this context, it can happen that the item to be printed is not fed onto the printing cylinder correctly or optimally, thus impairing the printing quality.

The second known method attempts to avoid this disadvantage by controlling the synchronisation between the printing cylinder and the screen carriage during the forward and return passes via two gear wheels on each end face of the printing cylinder. During the printing cycle (forward pass), the first gear wheel engages the toothed rack positioned on the corresponding side of the screen carriage. At the end of the printing cycle, this gear wheel and the toothed rack are disengaged due to the fact that the teeth at the appropriate point on the gear wheel are recessed by milling. The toothed rack can return freely over the stopped gear wheel. The return pass of the screen carriage is achieved by a second gear wheel which engages the toothed rack mounted on the corresponding side of the screen carriage during the return pass. During the return pass, the first gear wheel is held still by a mechanical device. After the return pass has been completed, the first gear wheel starts rotating again and engages the toothed rack of the screen carriage, at which point a new printing cycle begins. The two gear wheels are driven by a single drive motor. Due to the fact that the printing cylinder linked to the first gear wheel always rotates in the same direction and stops during the return pass of the screen carriage, there is sufficient time to feed the material to be printed onto the printing cylinder, given an appropriate printing speed.

However, the disadvantage of the second method is the technically complex mechanical synchronisation of the two gear wheels. This also leads to correspondingly high susceptibility to failure and to relatively frequent servicing of the cylinder screen printing machine. In addition, the printing speed is limited by the mechanical elements. Every increase in the printing speed also leads to a decrease in the idle time of the printing cylinder during the return pass of the screen carriage, which impairs the accurate feeding of the material to be printed onto the printing cylinder. On the whole, the economic efficiency of the two methods is very unsatisfactory due to the disadvantages described.

SUMMARY OF THE INVENTION

The present invention is based on the task of developing a method for controlling a cylinder screen printing machine which is characterised by high printing quality, great economic efficiency, simple technical equipment and high printing speeds. It is also the task of the present invention to develop a corresponding cylinder screen printing machine with the advantages described above.

As a solution to the task concerning the method, it is proposed in accordance with the invention that the printing cylinder and the screen carriage be driven independently of one another and that, during the printing cycle, the drive motor of the screen carriage be disengaged from the movement of the screen carriage which is synchronised with the printing cylinder and that the drive motor subsequently drive the screen carriage during the return pass, the printing cylinder being brought to a standstill before the return pass is completed.

Based on this solution in accordance with the invention, it is possible to accurately feed the material to be printed onto the printing cylinder during a sufficient idle time of the printing cylinder, which can amount to the entire return time of the screen carriage, or at least the remaining portion thereof, even at a high printing speed. The technical effort involved in implementing the method is relatively small. Although two drive motors are used to drive the printing cylinder and the screen carriage, the method can be realised with considerably simpler technical means than the second method described at the beginning and is also characterised by a less susceptibility to failure and easier servicing.

A preferred improvement of the method envisages that the drive motor of the screen carriage be brought to a standstill during the printing cycle and the drive motor of the printing cylinder before the return pass of the screen carriage has been completed. The drive motor of the printing cylinder, which comes to a standstill before the return pass has ended, holds the cylinder in the position in which the material to be printed is fed on during this time.

As a second solution to the task described above, it is proposed in accordance with the invention that the printing cylinder and the screen carriage be driven independently of one another, data for setting the printing path and the printing speed be programmed and stored in an electronic controller and converted into control signals for the drives, and that the respective movement positions of the printing cylinder and the screen carriage be determined by position sensor systems during the printing cycle and further processed by the electronic controller in order to regulate the control signals.

The advantages described above are also attained with this method in accordance with the invention. It is also possible to adapt the printing path and the printing speed to the surface to be printed and the other requirements of the respective material to be printed. In the conventional methods, the printing path covered by the screen carriage during the printing cycle corresponds to one complete turn of the printing cylinder and is matched to the maximum format size of the material to be printed. Thus, the printing ink is distributed by the flood coater over the entire screen surface, corresponding to the maximum printing format. The evaporation of the solvents contained in the printing ink during the spreading of the printing ink on the screen surface causes environmental pollution. The consistency of the printing ink also changes during spreading on the screen surface, due to evaporation and other influences, so that it must be frequently remixed in order to ensure a uniform printing quality. Due to the fact that the squeegee travels over the maximum printing format during every printing cycle, it is also exposed to a corresponding strain and the corresponding wear. These disadvantages are avoided by the second solution proposal in which the printing path can be adjusted to the respective surface of the material to be printed.

In a further development of this solution, the squeegee and the flood coater are also activated as a function of the movement position of the screen carriage. This enables more accurate and more simple control of the activation point of the squeegees, independently of the printing speed.

On the whole, the method in accordance with the invention offers the greatest possible flexibility as regards the printing cycle.

In accordance with the first solution, a cylinder screen printing machine of the type described at the beginning is designed to use two independent drive motors to drive the printing cylinder during the printing cycle and to drive the screen carriage during the return pass, a device with which the drive motor of the screen carriage can be disengaged during the printing cycle (forward pass of the screen carriage) from the movement of the screen carriage, which is synchronised to that of the printing cylinder, and a device with which the printing cylinder can be brought to a standstill before the return pass of the screen carriage has been completed.

In a preferred improvement, the drive motor of the screen carriage is linked to the screen carriage via a freewheel which disengages the drive motor from the screen carriage in the sense of rotation of the motor shaft corresponding to the forward pass of the screen carriage during the printing cycle, and the drive motor of the printing cylinder is linked to the printing cylinder via a freewheel which disengages the drive motor from the printing cylinder in the sense of rotation of the motor shaft corresponding to the return pass of the screen carriage.

The first freewheel can, for example, be located on the hub of the screen carriage drive motor and be designed as an industrial freewheel. The second freewheel can be respectively located on the two gear wheels of the printing cylinder, particularly when a gear wheel which is mounted on each end face of the printing cylinder and engages a toothed rack on the corresponding side of the screen carriage is used as a device for synchronising the movement of the printing cylinder and the screen carriage.

In accordance with the second proposed solution, a screen printing machine of the type described at the beginning is designed to have two independent drive motors for the printing cylinder and the screen carriage, and an electronic controller, consisting of a data input unit for setting the printing path and the printing speed, a connected PLC processor to convert the data into control signals for the drive motors, and two regulators respectively dedicated to the drive motors, connected to position sensor systems for the printing cylinder and the screen carriage.

In a preferred version, the position sensor systems are designed as rotary position transducers, which are mounted on the printing cylinder and on a drive wheel for the screen carriage.

In another preferred version, glass scales can also be used instead of rotary position transducers. Any other suitable position sensor system can also be considered.

BRIEF DRAWING DESCRIPTION

A preferred practical example of the invention is described in more detail below based on the drawings. The drawings show the following:

FIG. 1 A schematic diagram of a cylinder screen printing machine and

FIG. 2 A schematic diagram of an electronic controller for the cylinder screen printing machine illustrated in FIG. 1.

DESCRIPTION OF A PREFERRED EMBODIMENT

Figure 1:
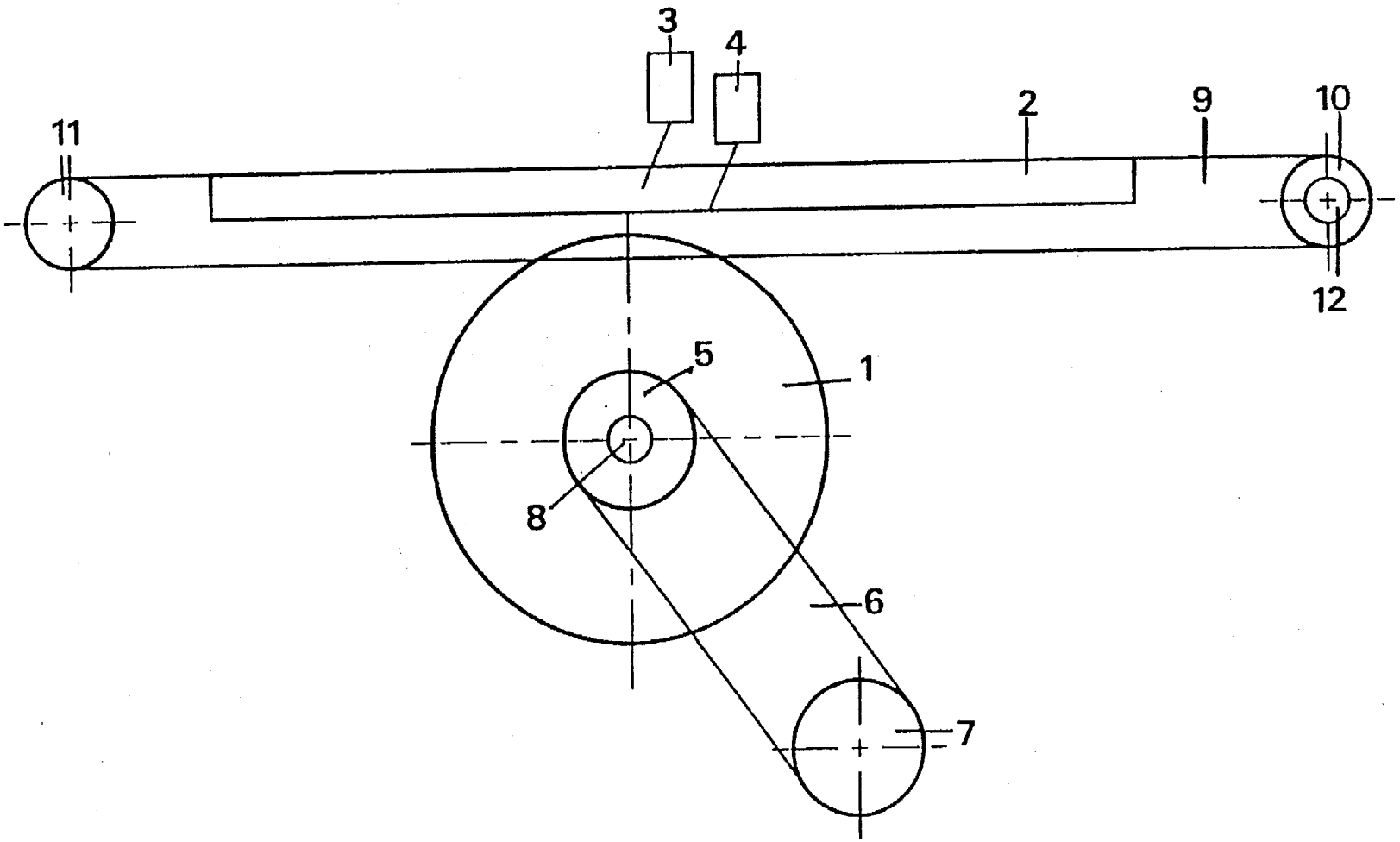

As FIG. 1 shows, the cylinder screen printing machine illustrated there essentially consists of a printing cylinder 1 which takes up the material to be printed, a screen carriage 2 running above it, a squeegee 3 which can be lowered onto the screen stencil and which is in raised position during the return pass shown in FIG. 1, and a flood coater 4 which is lowered during the return pass.

In the practical example shown, the printing cylinder 1 is connected to a drive 7 via a coaxial pulley 5, connected to the printing cylinder, and a toothed belt 6. The pulley 5 has a coaxial rotary position transducer, which serves as a position sensor system 8 for the angular distance covered by the cylinder from its starting position.

The screen carriage 2, which is moved in shuttle fashion by a toothed belt 9, runs over the printing cylinder 1. The reversing movement of the toothed belt 9 is driven by a drive wheel 10 and runs over pulley 11. The drive wheel 10 has a coaxial rotary position transducer which serves as a position sensor system 12 for the path covered by the screen carriage 2 from its starting position.

Figure 2:
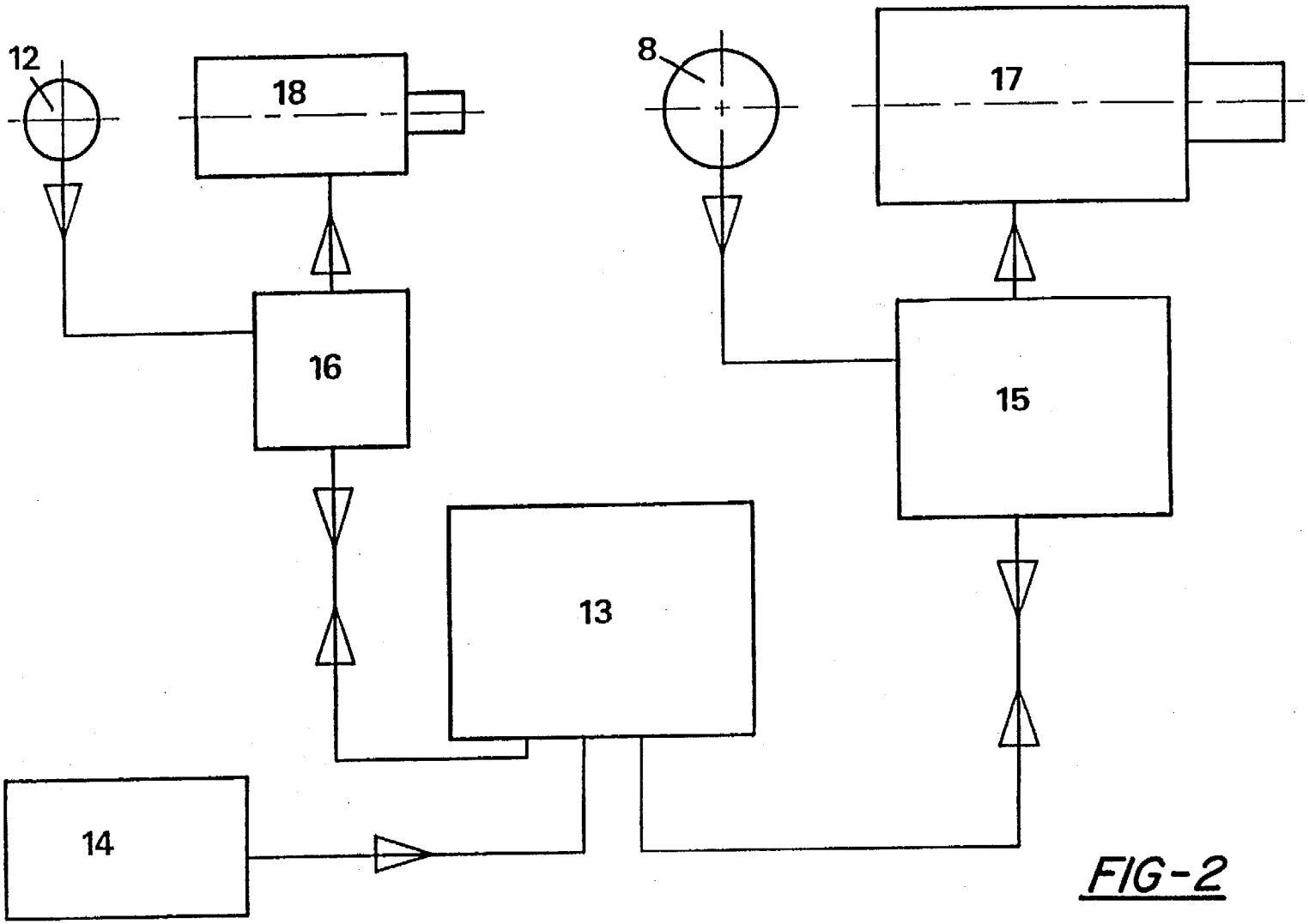

As the schematic diagram in FIG. 2 shows, the electronic controller for the cylinder screen printing machine illustrated in FIG. 1 essentially consists of a PLC processor 13 with an input unit 14 and one regulator 15 and 16 each for the drive motor 17 of the printing cylinder 1 and the drive motor 18 of the screen carriage 2.

The two drive motors 17 and 18 are controlled as follows:

Data for the printing path and the printing speed are entered via the input unit 14—a keyboard, for example—into the processor 13 and stored there. The processor 13 converts the data into control signals for the drive motors 17 and 18. The control signals are channelled to the corresponding regulators 15 and 16, where they are converted into the corresponding currents and voltages for the drive motors 17 and 18.

The printing cylinder 1 and the screen carriage 2 are at rest in the starting position of a printing cycle. The squeegee 3 and the flood coater 4 are in raised position. In this position, the material to be printed (not shown in the drawing) is fed onto the printing cylinder 1. The squeegee 3 is lowered onto the screen stencil (not shown in the drawing) of the screen carriage 2 at the beginning of the printing cycle. The printing cylinder 1 and the screen carriage 2 begin running at a synchronised speed resulting from the corresponding control signals.

The two position sensor systems 8 and 12 transmit the respective movement positions of the printing cylinder 1 and the screen carriage 2 to the regulators 15 and 16. The movement positions are compared in the regulators 15 and 16 with the printing path specified by the control signals. If the movement positions correspond to the associated control signals, a signal is sent from the respective regulator 15 or 16 to the processor 13, which then transmits a control signal to regulator 15 or 16 in order to stop the printing cylinder 1 or the screen carriage 2.

The printing cycle is concluded when the screen carriage 2 stops after covering the printing path programmed in the processor 13 and the squeegee 3 is lifted. During this time, the printing cylinder 1 continues to run in the same rotational direction until reaching the starting position.

When the screen carriage 2 stops at the end of the printing cycle, the flood coater 4 is lowered onto the screen stencil of the screen carriage 2. During the return pass of the screen carriage 2, which immediately follows the printing cycle, the screen carriage 2 is return to the starting position and stopped by a corresponding control signal. The flood coater 4 is raised after stopping. The printing cycle is concluded as soon as the printing cylinder 1 has reached its starting position again and the next item to be printed is fed onto the printing cylinder 1. The printing cycle then starts again from the beginning.

Reference Numbers

1 Printing cylinder
2 Screen carriage
3 Squeegee
4 Flood coater
5 Pulley
6 Toothed belt
7 Drive
8 Position sensor system
9 Toothed belt
10 Drive wheel
11 Pulley
12 Position sensor system
13 PLC processor
14 Input unit
15 Regulator
16 Regulator
17 Drive motor of the printing cylinder
18 Drive motor of the screen carriage

We claim:

1. A method for controlling a cylinder screen printing machine having a rotatable printing cylinder for taking up printable material, a reciprocable screen carriage for carrying a screen stencil in printing engagement with the printable material, a squeegee for controlling ink flow on the stencil, and means for synchronizing movement of the screen carriage and printing cylinder during forward motion in a printing cycle, said method characterized by:

synchronizing forward motion of the printing cylinder and the screen carriage during a printing cycle, and independently driving the screen carriage in a return motion back to a starting point, while continuing forward motion of the printing cylinder until reaching a starting point, at which point forward motion of the printing cylinder is stopped before the return motion of the screen carriage is completed.

2. A method as in claim 1 in which the forward motion of the printing cylinder is driven by a first motor and the return motion of the screen carriage is driven by a second motor wherein the second motor is brought to a stop during the printing cycle and the first motor is brought to a stop before the return motion of the screen carriage to the starting point has been completed.

3. A method as in claim 1 in which the printing cylinder and the screen carriage have independent drives controlled by an electronic controller, wherein data for setting a printing path length and printing speed are programmed and stored in said controller, the controller converts the data into control signals for the drives, and respective movement positions of the printing cylinder and screen carriage are sensed by position sensor systems during the printing cycle and fed to the electronic controller for processing to regulate the control signals.

4. A method as in claim 3 wherein a squeegee and a flood coater are activated by said electronic controller based upon movement of the screen carriage.

5. A cylinder screen printing machine having a rotatable printing cylinder for taking up printable material, a reciprocable screen carriage for carrying a screen stencil in printing engagement with the printable material, a squeegee for controlling ink flow on the stencil, and means for synchronizing movement of the screen carriage and printing cylinder during forward motion in a printing cycle, characterized by:

a first drive motor operative to drive the printing cylinder in a forward direction, said synchronizing means allowing return motion of the screen carriage without reverse motion of the cylinder, a second drive motor operative to drive the screen carriage in the reverse direction for return to a start position, the second motor being decoupled from the screen carriage during synchronized forward motion in a printing cycle, said first motor stopping forward drive motion of the printing cylinder prior to completion of the return motion of the screen carriage.

6. A cylinder screen printing machine as in claim 5 wherein said synchronizing means includes a freewheel that connects said second drive motor with the screen carriage to disengage the second motor from the screen carriage during rotation of the second motor in the forward direction and a second freewheel that connects the first drive motor with the printing cylinder to disengage the first motor from the printing cylinder for reverse rotation of the first drive motor.

7. A cylinder screen printing machine as in claim 5 wherein said first and second drive motors are independently directly connected with said printing cylinder and screen carriage respectively and said synchronizing means includes an electronic controller having a data input unit for setting the printing path and printing speed, a connected PLC processor to convert the data into control signals for the drive motors, and two regulators for the respective drive motors and connected to position sensor systems for the printing cylinder and the screen carriage.

8. A cylinder screen printing machine as in claim 7 wherein said position sensor systems are rotary position transducers respectively mounted on the printing cylinder and on a drive wheel for the screen carriage.

9. A cylinder screen printing machine as in claim 7 wherein said position sensor systems include glass scales.

* * * * *